United States Patent [19]

Zakay

[11] 4,023,595

[45] May 17, 1977

[54] FLOWRATE CONTROL DEVICE

[75] Inventor: Aba Zakay, Galil Elion, Israel

[73] Assignee: Mifal Leyitzur Mamtirim Veavizarei Hashkaya Bekibbutz Dan, Kibbutz Dan, Israel

[22] Filed: Mar. 23, 1976

[21] Appl. No.: 669,581

Related U.S. Application Data

[63] Continuation-in-part of Ser. No. 597,273, July 18, 1975, abandoned.

[30] Foreign Application Priority Data

July 30, 1974 Israel ..... 45369

[52] U.S. Cl. ..... 138/45; 138/46; 239/533.13; 239/542

[51] Int. Cl.[2] ..... B05B 1/30

[58] Field of Search ..... 239/230, 262, 534, 570, 239/542; 138/44, 45, 46

[56] References Cited

UNITED STATES PATENTS

| | | | |
|---|---|---|---|
| 2,764,183 | 9/1956 | Gollehon | 138/45 |
| 3,276,480 | 10/1966 | Kennedy | 138/45 |
| 3,791,764 | 2/1974 | Summer | 138/45 X |
| 3,837,363 | 9/1974 | Meronek | 138/45 |

*Primary Examiner*—Johnny D. Cherry
*Assistant Examiner*—Michael Mar
*Attorney, Agent, or Firm*—Ladas, Parry, Von Gehr, Goldsmith & Deschamps

[57] ABSTRACT

A flowrate control device comprising a housing, a housing inlet for coupling to a liquid flow supply, a housing outlet, a first housing wall portion defining a throughflow path communicating at the ends thereof respectively with the inlet and the outlet, a second housing wall portion defining a chamber communicating with the inlet and being otherwise closed, a flexible wall portion common to the first and second wall portions and serving as a separating partition between the chamber and the flowpath at least the first housing wall portion being formed with at least one tapering protrusion extending into the flowpath so as to form a construction therein and being so shaped that upon maximum displacement of the flexible wall portion into the flowpath a permanent residual flowpath remains open.

13 Claims, 16 Drawing Figures

FLOWRATE CONTROL DEVICE

Figure 1:
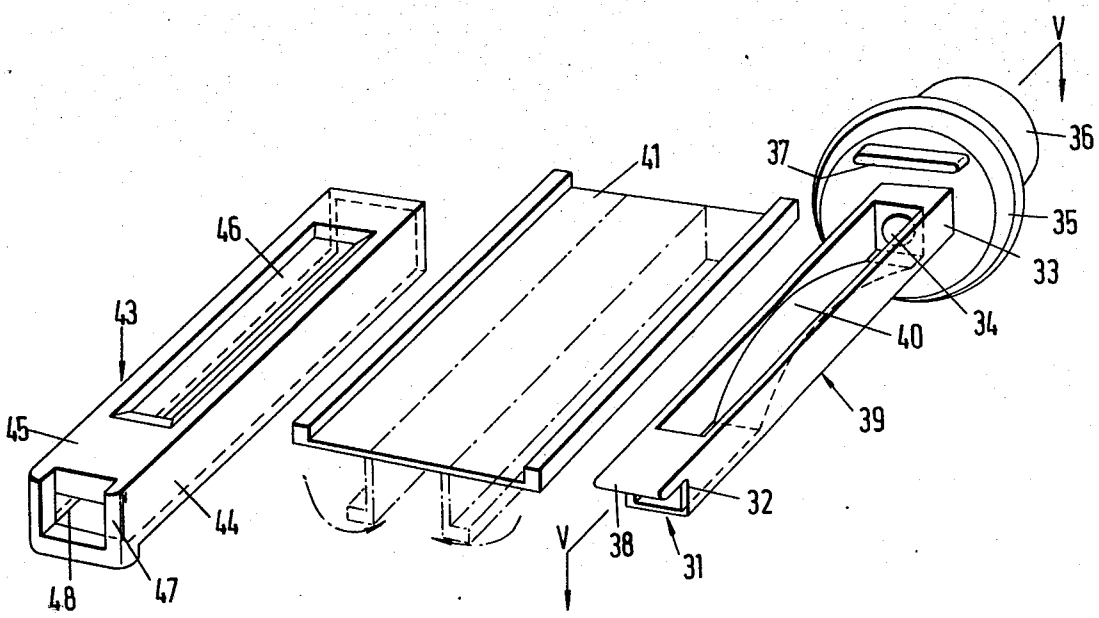

This application is a continuation-in-part of my copending application Ser. No. 597,273 filed July 18, 1975 now abandoned and relates to a flowrate control device particularly designed to control the rate of liquid flow so as to ensure a substantially constant delivery rate.

Such devices are of particular significance in irrigation where it is desired to ensure a uniform rate and density or irrigation. Thus, for example, when such a flowrate control device is associated with, or forms part of, a rotary water sprinkler of a kind (hereinafter referred to as "a rotary water sprinkler of the kind specified") having at least one nozzle radially located with respect to a central supply conduit with which it communicates and about which it is rotatably displaceable, the device ensures that the area sprayed by the sprinkler and the density of spray is substantially uniform from sprinkler to sprinkler and is substantially independent of supply pressure variations.

It is an object of the present invention to provide a new and improved flowrate control device.

According to one aspect of the present invention there is provided a flowrate control device comprising a housing, a housing inlet for coupling to a liquid flow supply, a housing outlet, a first housing wall portion defining a throughflow path communicating at the ends thereof respectively with said inlet and said outlet, a second housing wall portion defining a chamber communicating with said inlet and being otherwise closed, a flexible wall portion common to said first and second wall portions and serving as a separating partition between said chamber and said flowpath at least said first housing wall portion being formed with at least one tapering protrusion extending into said flowpath so as to form a constriction therein and being so shaped that upon maximum displacement of said flexible wall portion into said flowpath a permanent residual flowpath remains open.

With such a device the liquid in the chamber acquires the pressure of the supply flowing into the housing inlet. On the other hand, and in conformity with Bernoulli's law, the liquid flowing through the throughflow path having a significant velocity of flow is at a pressure which is significantly less than the pressure of the liquid, in relatively static flow conditions in the adjacent chamber. In view of the fact that the chamber is separated from the through flowpath by at least one resiliently flexible wall portion, this wall portion is resiliently displaced under the relatively increased pressure in the chamber into the through flowpath thereby reducing the through flow across section of the path. An equilibrium position is achieved corresponding to a constant flow rate through the through flowpath when the forces acting on either side of the resiliently flexible wall portion(s) are balanced, these forces being the liquid pressure obtaining in the chamber on the one hand and the liquid pressure in the through flowpath together with the restoring forces of the flexible wall portion on the other hand.

By virtue of the provision of the tapering protrusion it is ensured that throughflow speed gradually rises until it reaches a maximum in the region of maximum constriction and then drops with minimal energy losses.

According to a further aspect of the present invention there is provided a flowrate control device comprising a housing, a housing inlet for coupling to a liquid flow supply, a housing outlet, a flexible membrane retained within said housing, a first housing wall portion defining with said membrane a through flowpath communicating at the ends thereof respectively with said inlet and said outlet, a second housing wall portion defining with said membrane a chamber communicating with said inlet and being otherwise closed, said membrane serving as a separating partition between said path and said chamber.

Figure 2:
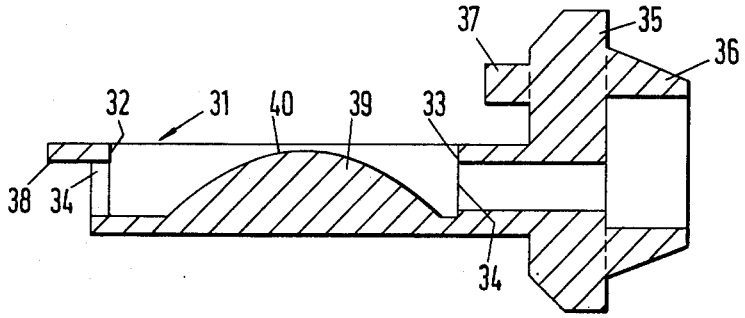
Figure 4:
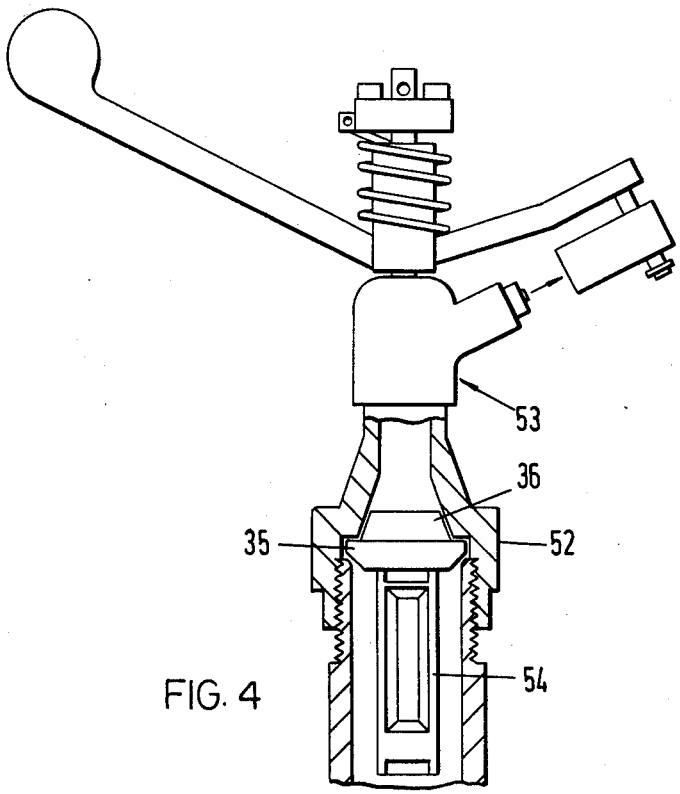
Figure 3:
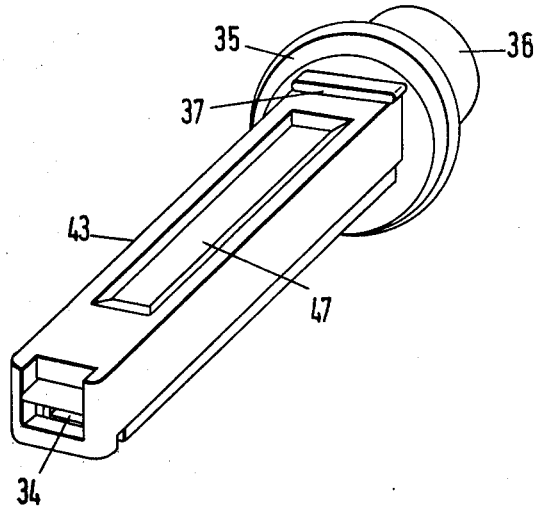
Figure 5:
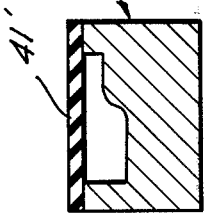
Figure 6:
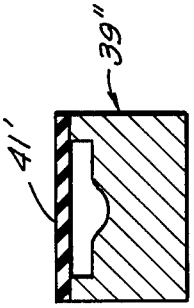
Figure 7:
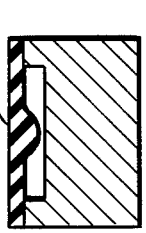
Figure 8:
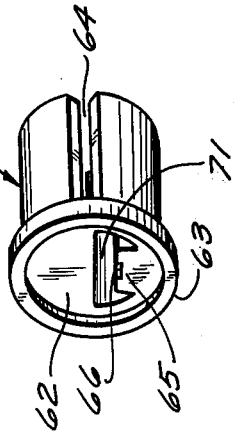
Figure 9:
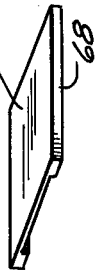
Figure 10:
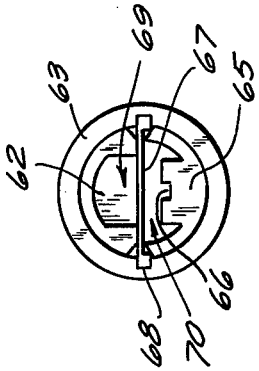
Figure 15:
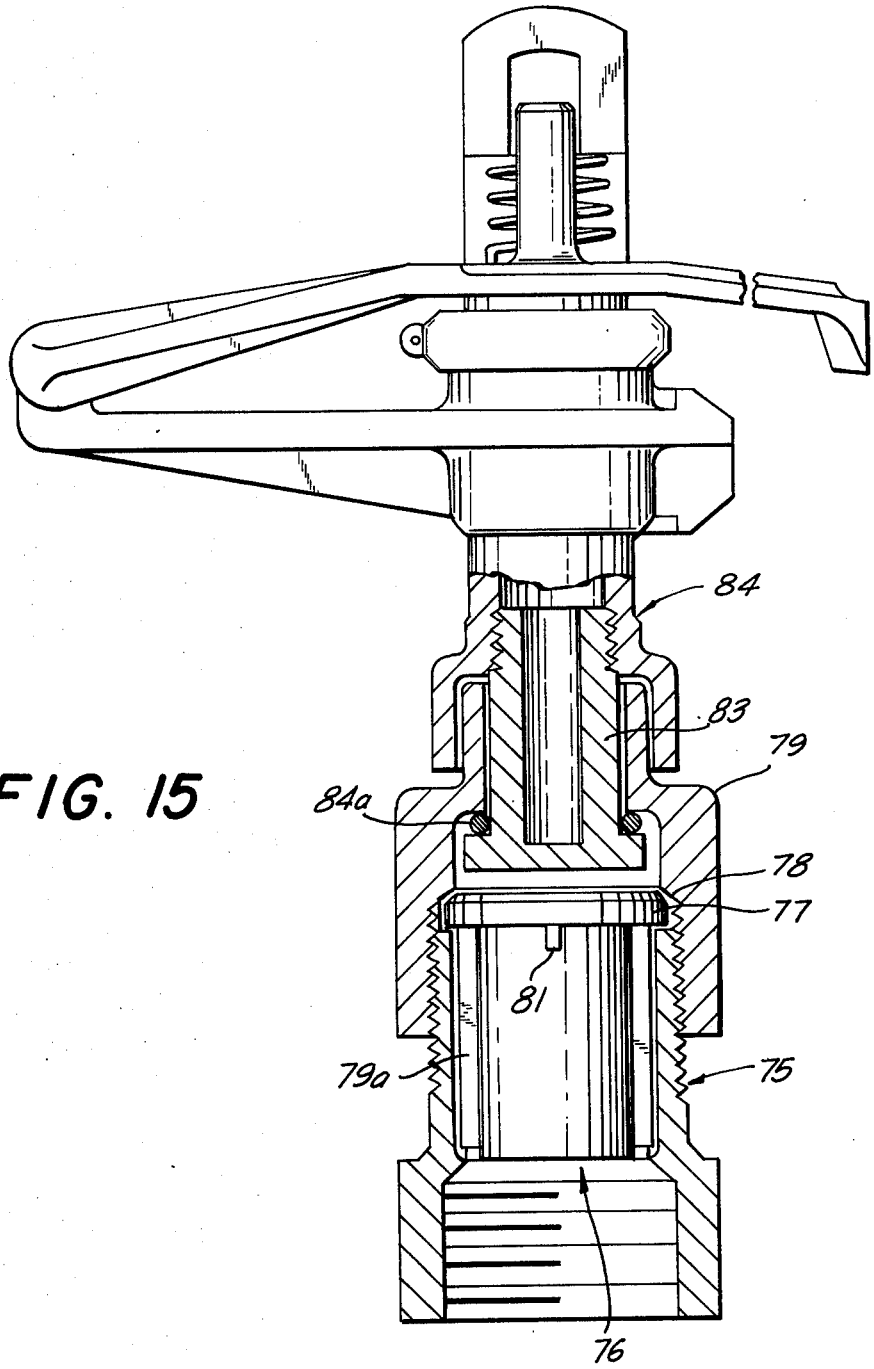

Embodiments of flowrate control devices in accordance with the present invention will now be described by way of example and with reference to the accompanying drawings in which:

FIG. 1 is a perspective view of the respective components of a control device in accordance with the present invention, FIG. 2 is a longitudinally sectioned side elevation of one of the components shown in FIG. 1 taken along the line II—II, FIG. 3 is a perspective view of the device when assembled, FIG. 4 shows the incorporation of the device shown in FIGS. 1 and 2 in a rotary water sprinkler of the kind specified, FIGS. 5, 6 and 7 are schematic cross sectional representations of variations in the device shown in the preceding drawings, FIGS. 8 and 9 are respective perspective views of the constituent components of a further form of control device in accordance with the present invention, FIG. 10 is an end-on elevation of the device whose constituent parts are shown in FIGS. 8 and 9, FIGS. 11 to 14 are respective perspective views of the constituent components of a still further form of control device in accordance with the present invention, FIG. 15 is a partially sectioned elevation of a rotary sprinkler incorporating a control device of the kind shown in FIGS. 8 to 10, and FIG. 16 is an end-on elevation of the base of the device shown in FIG. 15.

As shown in FIGS. 1 to 4 of the drawings the flowrate control device comprises an elongated channel member 31 having end walls 32 and 33. An inlet aperture 34 is formed in the end wall 32 and an outlet aperture 35 is formed in the end wall 33, the latter being formed integrally with an annular barrier wall 35. Formed integrally with an opposite surface of the barrier wall 35 is a tubular hub 36 having a tapering outer surface. Projecting from the barrier wall 35 in an opposite direction to the hub 36 and spaced from the channel member 31 is an abutment ridge 37 whilst projecting outwardly from the end wall 32 and flush with upper edge thereof is an abutment ridge 38.

Extending upwardly from a base of the channel member 31 is a crescent shaped barrier 39 which rises in a uniform curve from positions adjacent the inlet and outlet 34 and 35 achieving a maximum height at its central location 40.

A rectangular flexible rubber strip 41 is (as shown in FIG. 1) adapted to overlie the channel member 31 and is provided with upwardly directed longitudinal ridged edges 42.

A rectangular retaining member 43 is formed with a pair of side walls 44, an upper wall 45 in which is formed a rectangular aperture 46 and an end wall 47 in which is formed an aperture 48.

The device is assembled with the rubber strip 41 overlying the channel member 31 and retained in position by means of the retaining member 43 which fits over and around the channel member 31 with one edge thereof retained under the abutment ridge 37 and with the abutment ridge 38 passes through the aperture 48. The ridged edges 42 of the strip 41 engage the longitudinal edges of the retaining member 43.

When used with a rotary sprinkler of the kind specified, the assembled device is, as shown in FIG. 4 of the drawings, located in the mouth of a supply pipe 51, the tapering edge of the barrier wall 35 being pressed against the rim of the mouth by an inner flange of a coupling skirt 52 of a rotary sprinkler 53, the pipe 51 being screw coupled to the skirt 52.

As can be seen from FIG. 4 of the drawings, there is defined between the device and the surrounding pipe 51, a chamber 54 in which irrigation liquid is located in a substantially no-flow condition and at the supply pressure prevailing in the supply pipe 51. The irrigation liquid, on the other hand, passes through the device via the inlet 32 over the barrier 39 and out of the outlet 34 into the sprinkler.

As a consequence of the flow of the liquid at a significant speed through the device, the liquid pressure in the device falls as compared with the pressure in the chamber 54. The presence of the constricting barrier 39 with its graduated constriction results in the speed of throughflow gradually rising and the pressure gradually falling until they reach respective maximum and minimum at the central location 40 at which location flowrate control occurs.

The chamber 54 is separated from the location 40 by the rubber strip 41 and as the pressure difference on either side of the strip 41 rises (as a consequence of increase in supply pressure) the strip 41 flexes inwardly towards the location 40 so as to limit the flowpath through the device.

FIGS. 5, 6 and 7 show respectively modified cross-sectional views of the rubber strip and the constricting barrier illustrating how the shape of the strip and the barrier is such that upon maximum displacement of the strip into the flowpath a permanent residual flowpath remains open. Thus in FIG. 5 a planar strip 41' is employed located opposite a stepped barrier 39' such that upon maximum displacement of the strip 41' towards the barrier 39' a residual flowpath always remains open. Similarly in FIG. 6 a barrier 39'' is formed with a central groove ensuring the same result. In the embodiment shown in FIG. 7 a strip 41'' is formed with a longitudinal protruding rib which ensures that when the strip is pressed towards the barrier residual flowpaths remain open on either side of the rib.

FIGS. 8 to 10 show the construction of an alternative form of control device in accordance with the present invention. As seen in these Figures the device comprises a tubular housing 61 formed integrally at one end with an end wall 62 having an outwardly directed flange 63. The tubular housing 61 is formed with a pair of axial slits 64 which extend from an open end of the housing to the end wall 62. Extending longitudinally through the housing and formed integrally with a lower wall portion thereof is a longitudinal barrier 65 which tapers from the open end rim of the housing to a maximum height and then continues towards the region of the end wall 62. The longitudinal barrier 65 is formed with a central longitudinally extending groove 66.

As seen in FIG. 9 a flexible membrane is constituted by a rubber strip 67 provided at each longitudinal edge thereof with an edge flange 68. Upon assembly, as shown in FIG. 10 of the drawings the strip 67 is inserted into the housing 61 via the longitudinal slits 64 with the edge flanges 68 located outside the housing 61. In this way the device is formed with a chamber 69 open at one end and closed at the other end by the end wall 62 and a through flowpath 70 open at one end and open at the other end by means of a suitably formed aperture 71 in the end wall 62. The chamber 69 and through flowpath 70 are separated by means of the strip 67 which, when displaced towards the longitudinal barrier 65, constricts the flowpath but always leaves a residual flowpath open through the central longitudinal groove 66 and on either side of the barrier 65.

Whilst in the embodiment shown in FIGS. 8, 9 and 10 of the drawings the longitudinal barrier 65 is formed integrally with tubular housing 61 and the flow characteristics associated with this barrier 65 are fixed, as far as this housing is concerned, in the embodiment shown in FIGS. 11 to 14 of the drawings the barrier is provided by a replaceable insert.

Figure 12:
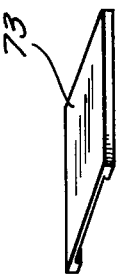
Figure 11:
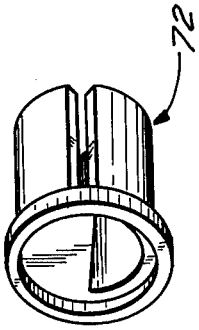
Figure 13:
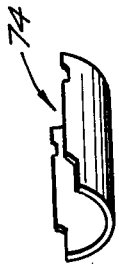
Figure 14:
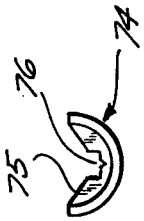

As seen in these Figures, FIGS. 11 and 12 show a housing 72 and flexible membrane 73 substantially on the lines of those shown and described with reference to FIGS. 8 and 9. Insertable into the lower portion of the housing is an insert 74 shown in perspective view in FIG. 13 and in end view in FIG. 14. This insert fits closely within the housing 72 and is crescent shaped and formed with a tapering longitudinal barrier 75 having a central longitudinal groove 76. This barrier serves in the same way as the barriers described above to restrict the control region in a gradual manner whilst maintaining a residual flowpath therethrough irrespective of the maximum displacement of the membrane 73. Where, however, it is desired to change the flow conditions, an insert having one particular type of barrier can be readily replaced by an insert having an alternative kind of barrier.

Figure 16:
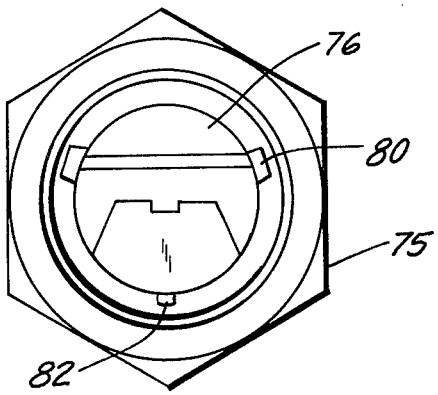

Reference will now be made to FIGS. 15 and 16 of the drawings which illustrate the incorporation of a control device such as that shown in FIGS. 11–14 of the drawings in a rotary sprinkler. As seen in these drawings a central supply conduit coupling piece 75 is fitted with a control device 76 of the kind shown in FIGS. 11 to 14 of the drawings, an end wall flange 77 of the control device 76 being sandwiched between the upper edge of the coupling piece 75 and a corresponding flanged shoulder 78 formed in a coupling collar 79 which is screw-coupled to the coupling piece 75. End flanges **79*a* of a membrane of the control device 76 are keyed in appropriate longitudinal grooves 80 formed in the internal cylindrical wall of the coupling piece 75 whilst a locating rib 81, formed integrally with the control device 76 is similarly keyed in a short locating groove 82. Located within the coupling collar 79 and extending therefrom is a sprinkler coupling tube 83 which is screw-coupled at its upper end to a rotary sprinkler 84 of conventional construction and is rotatable therewith with respect to the coupling collar 79 and coupling piece 75 via a bearing seal 84*a***

Water flows from a supply conduit (not shown) through the control device 76 to the rotary sprinkler 84 to be discharged thereby. A portion of the water remains trapped at supply pressure in the chamber defined by the end wall and the membrane whilst the remaining portion of the water passes through the through flowpath defined between the membrane and the longitudinal barrier. Flow control with this device takes place in the manner as described above, it being realised that even under maximum displacement of the membrane towards the barrier a residual flowpath always remains open.

It will be appreciated that the devices described above can be used as flowrate control devices with other than rotary water sprinklers.

I claim

1. A flowrate control device comprising a housing, a housing inlet for coupling to a liquid flow supply, a housing outlet, a first housing wall portion defining a throughflow path communicating at the ends thereof respectively with said inlet and said outlet, a second housing wall portion defining a chamber communicating with said inlet and being otherwise closed, a flexible wall portion common to said first and second wall portions and serving as a separating partition between said chamber and said flowpath at least said first housing wall portion being formed with at least one tapering protrusion extending into said flowpath so as to form a constriction therein and being so shaped that upon maximum displacement of said flexible wall portion into said flowpath a permanent residual flowpath remains open.

2. A control device according to claim 1 wherein said protrusion is formed on a rigid wall portion opposite said flexible wall portion.

3. A control device according to claim 1 wherein said protrusion is formed on said flexible wall portion.

4. A control device according to claim 2 wherein a series of stepped protrusions are formed on said rigid wall portion.

5. A flowrate control device comprising a housing, a housing inlet for coupling to a liquid flow supply, a housing outlet, a flexible membrane retained within said housing, a first housing wall portion defining with said membrane a throughflow path communicating at the ends thereof respectively with said inlet and said outlet, at least one tapering protrusion formed integrally with at least said first housing wall portion, extending into said through-flowpath so as to form a constriction therein, a second housing wall portion defining with said membrane a chamber communicating with said inlet and being otherwise closed, said membrane serving as a separating partition between said path and said chamber.

6. A control device according to claim 5 wherein said protrusion is formed on the first housing wall portion.

7. A control device according to claim 5 wherein said protrusion is formed on said membrane.

8. A control device according to claim 5 wherein said protrusion is so shaped that upon maximum displacement of said membrane into said flowpath a permanent residual flowpath remains open.

9. A flowrate control device comprising a housing, a housing inlet for coupling to a liquid flow supply, a housing outlet, first and second housing side wall portions, a housing end wall formed integrally with said side wall portions, said side wall portions defining between them a receiving slit, a flexible membrane to be retained in said slit and defining with said first side wall portion a through path, said end wall having formed therein said outlet with which said through flowpath communicates at one end, said side wall portions defining at an opposite end said housing inlet with which said path communicates at its opposite end, said membrane defining with said second side wall portion a chamber closed at one end by said end wall and communicating at an opposite end with said housing inlet.

10. A control device according to claim 9 wherein said first wall portion is formed with at least one tapering protrusion which extends into said flowpath so as to form a construction therein and being so shaped that upon maximum displacement of said membrane into said flowpath a permanent residual flowpath remains open.

11. A control device according to claim 10 wherein said protrusion is constituted by an axially directed elevation which is formed with a central groove.

12. A control device according to claim 10 wherein there is furthermore provided an insert on which is formed said protrusion and which is retainable in said path opposite said membrane.

13. A flowrate control device comprising a conduit member having defined therein an elongated aperture, an inlet and an outlet of said conduit member, a flexible membrane sealing said aperture, retaining means for retaining said membrane in said sealing position, a transversely directed rigid wall portion integral with said member, a protrusion formed integrally with said member and tapering uniformly to a minimum adjacent said inlet and outlet, said conduit member being insertable into a surrounding housing so as to define therewith a chamber sealed at one end by said transversely directed rigid wall portion and communicating at the other end with said inlet.

* * * * *